US009987643B2

(12) United States Patent
Burns

(10) Patent No.: US 9,987,643 B2
(45) Date of Patent: Jun. 5, 2018

(54) SYSTEM AND METHOD HAVING MULTI-COMPONENT CONTAINER FOR SPRAY DEVICE

(71) Applicant: Carlisle Fluid Technologies, Inc., Charlotte, NC (US)

(72) Inventor: Marvin Dean Burns, Millbury, OH (US)

(73) Assignee: Carlisle Fluid Technologies, Inc., Scottsdale, AZ (US)

( * ) Notice: Subject to any disclaimer, the term of this patent is extended or adjusted under 35 U.S.C. 154(b) by 389 days.

(21) Appl. No.: 13/787,640

(22) Filed: Mar. 6, 2013

(65) Prior Publication Data

US 2013/0233944 A1 Sep. 12, 2013

Related U.S. Application Data

(60) Provisional application No. 61/608,014, filed on Mar. 7, 2012.

(51) Int. Cl.
*B05B 7/24* (2006.01)
*B05B 1/30* (2006.01)
(Continued)

(52) U.S. Cl.
CPC ..... *B05B 7/247* (2013.01); *B05B 1/14* (2013.01); *B05B 1/3066* (2013.01);
(Continued)

(58) Field of Classification Search
CPC ..... B05B 11/0078; B05B 11/0081; B05B 7/2472; B05B 7/0408; B05B 7/04;
(Continued)

(56) References Cited

U.S. PATENT DOCUMENTS 5,052,623 A * 10/1991 Nordeen ..... 239/305
5,402,916 A 4/1995 Nottingham et al.
(Continued)

FOREIGN PATENT DOCUMENTS

EP 1022060 A3 7/2000
JP S60-005249 1/1985
(Continued)

OTHER PUBLICATIONS

PCT International Search Report & Written Opinion for PCT Application No. PCT/US2013/029707; dated Aug. 14, 2013.
(Continued)

*Primary Examiner* — Arthur O Hall
*Assistant Examiner* — Juan C Barrera
(74) *Attorney, Agent, or Firm* — Fletcher Yoder, P.C.

(57) ABSTRACT

A system may include a spray device having a body with a first liquid passage configured to flow a first liquid and a second liquid passage configured to flow a second liquid. The spray device also may include a spray head configured to output a spray of the first liquid and the second liquid. In addition, the spray device may include a multi-component container coupled to the body, wherein the multi-component container comprises a first container portion having a first outlet configured to supply the first liquid to the first liquid passage and a second container portion having a second outlet configured to supply the second liquid to the second liquid passage, and the first and second outlets are positioned in close proximity to one another.

26 Claims, 10 Drawing Sheets

(51) Int. Cl.

| | |
|---|---|
| ***B05B 7/04*** | (2006.01) |
| ***B05B 7/12*** | (2006.01) |
| ***B05B 1/14*** | (2006.01) |
| *B05B 7/06* | (2006.01) |
| *B05B 7/08* | (2006.01) |

(52) U.S. Cl.
CPC ..... *B05B 7/0408* (2013.01); *B05B 7/1209* (2013.01); *B05B 7/2424* (2013.01); *B05B 7/2435* (2013.01); *B05B 7/2472* (2013.01); *B05B 7/066* (2013.01); *B05B 7/067* (2013.01); *B05B 7/0815* (2013.01); *B05B 7/2437* (2013.01); *B05B 7/2454* (2013.01); *B05B 7/2478* (2013.01)

(58) Field of Classification Search
CPC ..... B05B 7/062; B05B 7/2424; B05B 7/247; B05B 7/2435; B05B 7/1209; B05B 7/2437; B05B 7/2454; B05B 7/066; B05B 7/067; B05B 7/0815; B05B 7/2478; B05B 1/3066; B05B 1/14
USPC .... 239/417.5, 419, 423, 375, 379, 345, 303, 239/304, 306, 398–434.5
See application file for complete search history.

(56) References Cited

U.S. PATENT DOCUMENTS

| | | | | |
|---|---|---|---|---|
| 5,941,420 | A * | 8/1999 | Connan | 222/94 |
| 6,283,385 | B1 * | 9/2001 | Beaver et al. | 239/10 |
| 7,090,072 | B1 * | 8/2006 | Elliott | 206/15.3 |
| 2003/0006310 | A1 | 1/2003 | Rothrum et al. | |
| 2010/0098870 | A1 * | 4/2010 | Staunton et al. | 427/426 |
| 2010/0270401 | A1 * | 10/2010 | Charpie et al. | 239/417.5 |
| 2013/0071570 | A1 * | 3/2013 | Larson | 427/372.2 |

FOREIGN PATENT DOCUMENTS

| | | | |
|---|---|---|---|
| JP | S63-076057 | | 6/1988 |
| JP | 2004-223486 | A | 8/2004 |
| JP | 2009-131590 | A | 6/2009 |
| RU | 2342265 | C2 | 12/2008 |
| WO | 98/32539 | A1 | 7/1998 |

OTHER PUBLICATIONS

Canadian Office Action; Application No. CA 2,865,625; dated Aug. 6, 2015; 4 pages.
EP Examination Report; Application No. EP 13712025.9; dated Jun. 25, 2015; 4 pages.
Japanese Office Action and English Translation; Application No. JP 2014-561123; dated Aug. 18, 2015; 13 pages.
RU Official Action and English Translation; Application No. RU 2014140329; dated Nov. 27, 2015; 12 pages.
AU Examination Report No. 2; Application No. AU 2013230703; dated Nov. 17, 2015; 6 pages.
AU Patent Examination Report No. 3; Application No. AU 2013230703; dated May 13, 2016; 5 pages.
EP Communication Pursuant to Article 94(3) EPC; Application No. EP 13712025.9; dated Jun. 15, 2016; 3 pages.
JP Final Notice of Reasons for Rejection and English Translation; Application No. JP2014-561123; dated Mar. 29, 2016; 8 pages.

* cited by examiner

SYSTEM AND METHOD HAVING MULTI-COMPONENT CONTAINER FOR SPRAY DEVICE

CROSS REFERENCE TO RELATED APPLICATION

This application claims priority to and benefit of U.S. Provisional Patent Application No. 61/608,014 entitled "SYSTEM AND METHOD HAVING MULTI-COMPONENT CONTAINER FOR SPRAY DEVICE", filed Mar. 7, 2012, which is herein incorporated by reference in its entirety.

BACKGROUND

The invention relates generally to systems and methods for spraying substances, such as coating substances (e.g., paint).

A variety of spray devices may be used to apply a spray to a target object. For example, a spray device may have a gravity feed container, which supplies a liquid (e.g., paint) into the spray device for generation of a liquid spray. In certain applications, the liquid may include multiple components (e.g., liquid paints) mixed together to create a liquid mixture (e.g., paint mixture). For example, a painter may mix these multiple components together separate from the spray device, pour the liquid mixture into the gravity feed container, attach the gravity feed container to the spray device, and then commence spraying the liquid mixture onto a target object. Unfortunately, a chemical reaction starts once the multiple components are mixed together, thereby limiting the amount of time to use the liquid mixture. After a job is complete, the operator discards any residual liquid mixture and cleans the spray device, because the liquid mixture is not usable for a later job due to the chemical reaction. The foregoing system and procedure results in a significant waste in time and materials. Unfortunately, it is particularly challenging to mix multiple components (e.g., liquid paints) in a spray device, particularly in context of a gravity feed spray device. Accordingly, a need exists for an improved spray device having features to enable supply of multiple components to a spray device, and for internal mixing of the multiple components in the spray device.

BRIEF DESCRIPTION

A system, in certain embodiments, may include a spray device having a body with a first liquid passage configured to flow a first liquid and a second liquid passage configured to flow a second liquid. The spray device also may include a spray head configured to output a spray of the first liquid and the second liquid. In addition, the spray device may include a multi-component container coupled to the body, wherein the multi-component container comprises a first container portion having a first outlet configured to supply the first liquid to the first liquid passage and a second container portion having a second outlet configured to supply the second liquid to the second liquid passage, and the first and second outlets are positioned in close proximity to one another.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
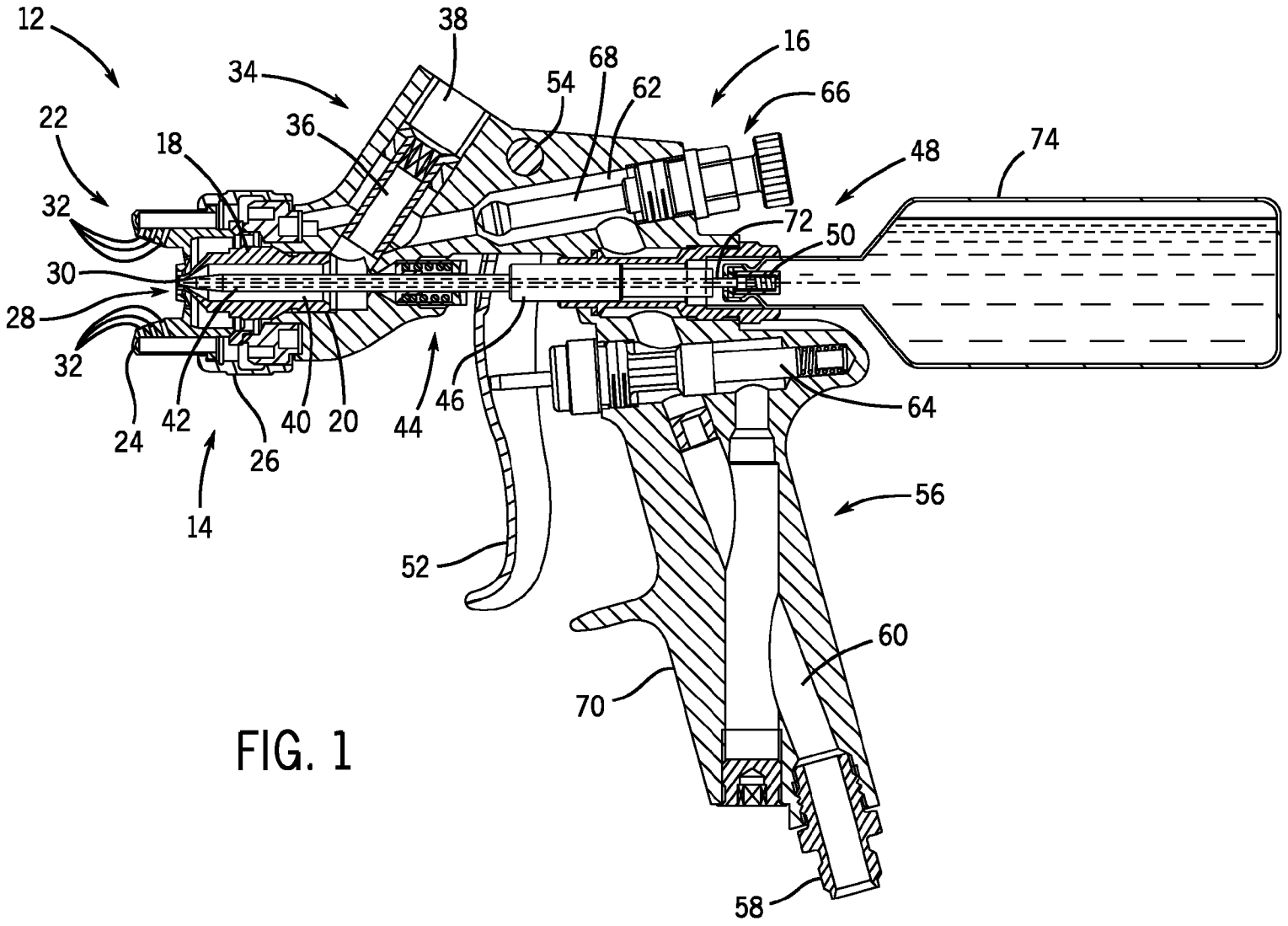
FIGS. 1 and 2 are cross-sectional side views of an exemplary embodiment of a spray device employing a needle for applying multiple component materials.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed in detail below with reference to FIGS. 11-19, the disclosed embodiments may employ a multi-component container (e.g., a gravity feed spray container) with a nonsymmetrical configuration of outlets (e.g., each container portion has an outlet offset from a centerline of the respective container portion) and/or a nested configuration of container portions (e.g., one container portion partially recessed within another container portion). The multi-component container is configured to supply (e.g., gravity feed) a plurality of liquids to a spray device (e.g., spray gun). In particular, the multi-component container may include a plurality of container portions coupled together in a nested configuration, a side-by-side configuration, or a docked configuration. For example, the nested configuration may have a first container portion extending completely or partially around a second container portion. Accordingly, the nested configuration may also be described as a docked configuration, wherein a second container portion is at least partially recessed into a first container portion. By further example, the side-by-side configuration may have a first container portion disposed directly adjacent a second container portion. In certain embodiments, the first container portion and the second container portion are coupled together by at least one removable fastener, such as a strap, a clamp, a bolt, a thread, a snap-fit mechanism, a latch, or any combination thereof.

In each of these configurations of container portions, each one of the plurality of container portions may have a separate outlet, wherein the outlets may be arranged in close proximity to one another, e.g., nested or side-by-side. As noted above, each outlet may be in a nonsymmetrical configuration (e.g., off center) relative to a central axis of the respective container portion, thereby making the container portion as a whole in a nonsymmetrical configuration. This nonsymmetrical configuration of the outlets (e.g., in close proximity to one another) may help provide a more uniform flow of each liquid to the spray device. For example, by providing the outlets in close proximity to one another, each liquid flow path may be substantially the same, thereby providing a more uniform flow distance and thus flow rate of the liquids into the spray device. Otherwise, if each container portion had an outlet at a different distance from the spray device, then the spray device may receive non-uniform flow rates and/or amounts of each liquid, thereby causing non-uniformities in the liquid mixture and thus the liquid spray output by the spray device. Accordingly, the nonsymmetrical configuration of the outlets is configured to enable an efficient and high performance mixing of multiple components (e.g., liquid paints) directly in or at the spray device, thereby reducing waste in time and materials.

In addition, as discussed further below with reference to FIGS. 1-10, the disclosed embodiments include a spray device with a needle for applying multiple component material. In accordance with certain embodiments, a first component material may be delivered to the fluid tip of the spray device from a first component material chamber defined between an inner passage of the fluid delivery tip assembly and the fluid needle of the spray device. At the same time, a second component material may be delivered to the fluid tip of the spray device through a hollow center of the fluid needle. As such, the first and second component materials may be mixed at or near the fluid tip of the spray device, instead of being premixed prior to spraying. By not premixing the first and second component materials, several shortcomings of conventional spraying techniques may be addressed. For example, excess waste materials may be reduced because the first and second component materials are only mixed upon spraying. In addition, because mixing generally occurs in front of the fluid tip exit of the spray device, cleaning of the spray device may be required less frequently and may be less time consuming.

Figure 2:
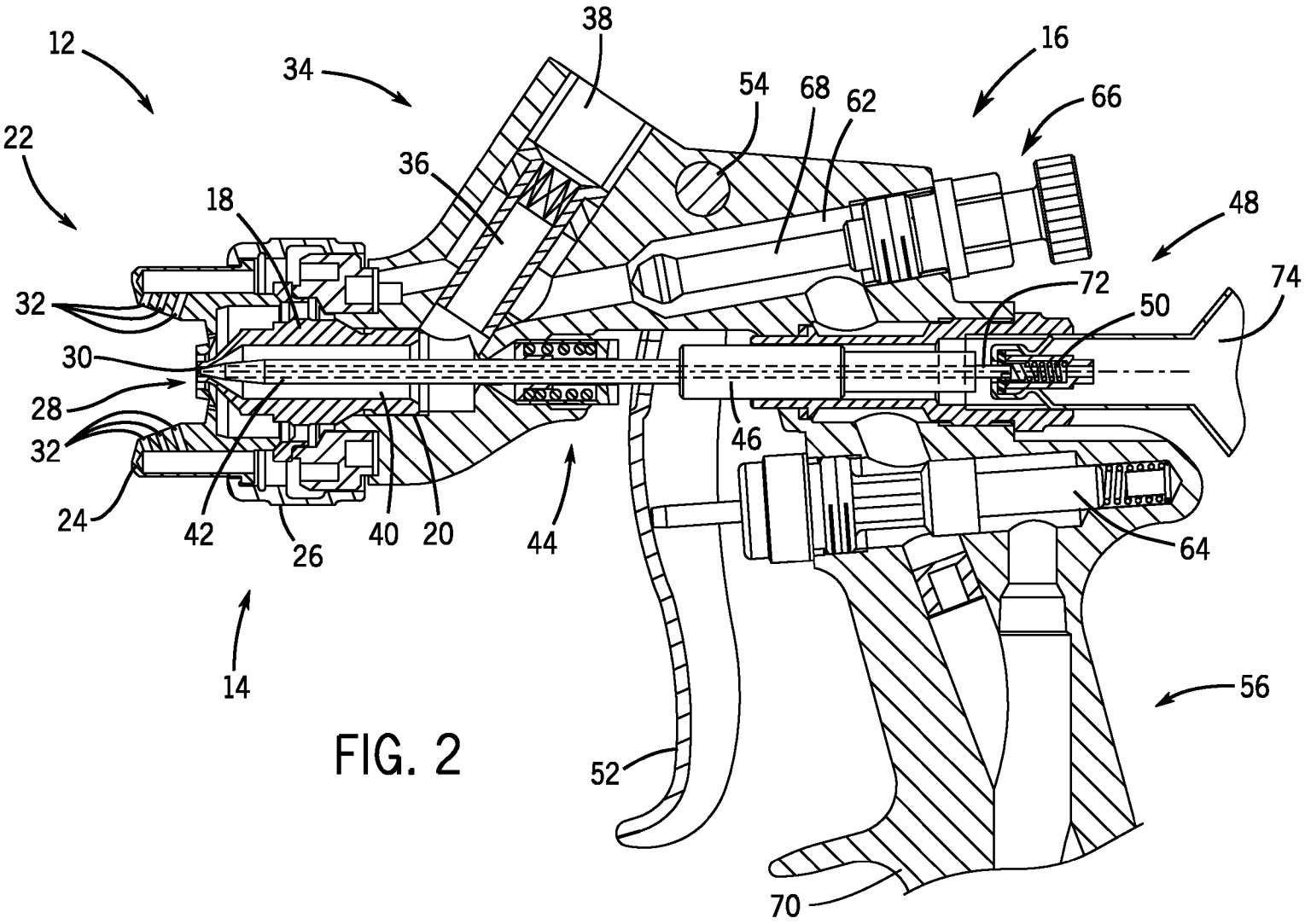

Turning now to the drawings, FIGS. 1 and 2 are cross-sectional side views of an exemplary embodiment of a spray device 12 (e.g., spray coating gun) employing a needle for applying multiple component materials. As illustrated, the spray device 12 includes a spray tip assembly 14 coupled to a body 16. The spray tip assembly 14 includes a fluid delivery tip assembly 18, which may be removably inserted into a receptacle 20 of the body 16. For example, a plurality of different types of spray coating devices may be configured to receive and use the fluid delivery tip assembly 18. The spray tip assembly 14 also includes a spray formation assembly 22 coupled to the fluid delivery tip assembly 18. The spray formation assembly 22 may include a variety of spray formation mechanisms, such as air, rotary, and electrostatic atomization mechanisms. However, the illustrated spray formation assembly 22 comprises an air atomization cap 24, which is removably secured to the body 16 via a retaining nut 26. The air atomization cap 24 includes a variety of air atomization orifices, such as a central atomization orifice 28 disposed about a fluid tip exit 30 from the fluid delivery tip assembly 18. The air atomization cap 24 also may have one or more spray shaping orifices 32, which force the spray to form a desired spray pattern (e.g., a flat spray). The spray formation assembly 22 also may comprise a variety of other atomization mechanisms to provide a desired spray pattern and droplet distribution.

The body 16 of the spray device 12 includes a variety of controls and supply mechanisms for the spray tip assembly 14. As illustrated, the body 16 includes a first component material delivery assembly 34 having a first component material inlet passage 36 extending from a first component material inlet coupling 38 to a first component material chamber 40, which is generally defined as a passage between an inner wall of the fluid delivery tip assembly 18 and an outer surface of a multiple component delivery needle 42 of a fluid needle valve assembly 44. The first component material delivery assembly 34 may be configured to deliver a first component material into the first component material chamber 40 using gravity feed techniques, pressure feed techniques, suction feed techniques, or any other suitable method of delivery.

For example, in certain embodiments, a gravity feed reservoir may be coupled to the first component material inlet coupling 38 such that the forces of gravity cause the first component material to be delivered from the gravity feed reservoir into the first component material chamber 40. However, in other embodiments, a pressure feed reservoir may be coupled to the first component material inlet coupling 38 such that the pressure of the first component material in the pressure feed reservoir causes the first component material to be delivered from the pressure feed reservoir into the first component material chamber 40. In this embodiment, the pressure of the first component material in the pressure feed reservoir may be selectively adjusted based on operating conditions of the spray device 12. For example, the pressure of the first component material may be selectively adjusted based on pressures and/or flow rates of a second component material, which may be delivered through a hollow center passage through the multiple component delivery needle 42. The selective adjustment of pressures and/or flow rates of the first and second component materials may be performed during calibration of the spray device 12. In addition, in other embodiments, the first component material may be delivered from the first component material chamber 40 using suction feed techniques. In other words, the first component material may be siphoned out of the first component material chamber 40 from a low pressure area created by the pressurized flow of the second component material from the hollow center passage of the multiple component delivery needle 42.

In addition, the multiple component delivery needle 42 may be configured to at least partially control the flow rate of the first component material from the first component material chamber 40 through the fluid tip exit 30 of the fluid delivery tip assembly 18. The multiple component delivery needle 42 includes an enlarged body portion 46 extending moveably through the body 16 between the fluid delivery tip assembly 18 and a fluid valve 48. In certain embodiments, the fluid valve 48 may include a spring 50 that enables the fluid valve 48 to bias the multiple component delivery needle 42 toward the fluid delivery tip assembly 18. The enlarged body portion 46 of the multiple component delivery needle 42 is also coupled to a trigger 52, such that the enlarged body portion 46 (and the multiple component delivery needle 42) may be moved away from the fluid delivery tip assembly 18 as the trigger 52 is rotated counter clockwise about a pivot joint 54. However, any suitable inwardly or outwardly openable valve assembly may be used within the scope of the present embodiments.

An air supply assembly 56 is also disposed in the body 16 to facilitate atomization at the spray formation assembly 22. The illustrated air supply assembly 56 extends from an air inlet coupling 58 to the air atomization cap 24 via air passages 60 and 62. The air supply assembly 56 also includes a variety of seal assemblies, air valve assemblies, and air valve adjusters to maintain and regulate the air pressure and flow rate through the spray device 12. For example, the illustrated air supply assembly 56 includes an air valve assembly 64 coupled to the trigger 52, such that rotation of the trigger 52 about the pivot joint 54 opens the air valve assembly 64 to allow air flow from the first air passage 60 to the second air passage 62. The air supply assembly 56 also includes an air valve adjustor 66 coupled to an air needle 68, such that the air needle 68 is movable via rotation of the air valve adjustor 66 to regulate the air flow to the air atomization cap 24. As illustrated, the trigger 52 is coupled to both the fluid needle valve assembly 44 and the air valve assembly 64, such that fluid and air simultaneously flow to the spray tip assembly 14 as the trigger 52 is pulled toward a handle 70 of the body 16. Once engaged, the spray device 12 produces an atomized spray with a desired spray pattern and droplet distribution of the mixture of the first and second component materials.

More specifically, as the trigger 52 is pulled toward the handle 70 of the body 16, the multiple component delivery needle 42 is unseated from the fluid delivery tip assembly 18 and moves inwardly away from the fluid delivery tip assembly 18 such that the first component material is allowed to flow from the first component material chamber 40 through the fluid tip exit 30 of the fluid delivery tip assembly 18. At the same time, in certain embodiments, a valve end 72 of the multiple component delivery needle 42 may unseat the fluid valve 48, which may be coupled to a pressure vessel 74, allowing the second component material to flow through the hollow center of the multiple component delivery needle 42 to the atomization and mixing zone just outside the fluid tip exit 30. In this manner, the multiple component delivery needle 42 may proportionally control the flow of the first and second component materials. However, in other embodiments, the fluid valve 48 may be actuated by other components when the trigger 52 is pulled, enabling flow through the hollow center of the multiple component delivery needle 42. For example, in certain embodiments, the valve end 72 of the multiple component delivery needle 42 may include holes in its sides, such that when the holes are uncovered, the second component material flows into the hollow center passage. In addition, in other embodiments, a rotary valve may be used to enable the flow of the second component material through the hollow center passage of the multiple component delivery needle 42.

The pressure vessel 74 may be pressurized such that the flow of the second component material is pressure fed. As such, the pressure of the second component material in the pressure vessel 74 may be selectively adjusted based on operating conditions of the spray device 12. For example, the pressure of the second component material may be selectively adjusted based on pressures and/or flow rates of the first component material delivered from the first component material chamber 40 around the multiple component delivery needle 42. The selective adjustment of pressures and/or flow rates of the first and second component materials may be performed during calibration of the spray device 12. However, in other embodiments, the second component material may also be gravity fed, suction fed, or delivered using any suitable feeding techniques.

As described above, the second component material may flow through the center of the hollow multiple component delivery needle 42 toward the fluid tip exit 30 of the fluid delivery tip assembly 18. As such, the first and second component materials are not premixed. Rather, the first and second component materials may be delivered to the front of the spray device 12, where the first and second component materials are mixed external to the spray device 12 during atomization. The hollow center passage may extend axially through at least a portion of the multiple component delivery needle 42. In other words, in certain embodiment, the hollow center passage may not extend axially through the entire length of the multiple component delivery needle 42. Rather, the hollow center passage may only extend halfway through the multiple component delivery needle 42, with the second component material exiting at a different location than in the embodiment where the hollow center passage extends through the entire length of the multiple component delivery needle 42.

Figure 3:
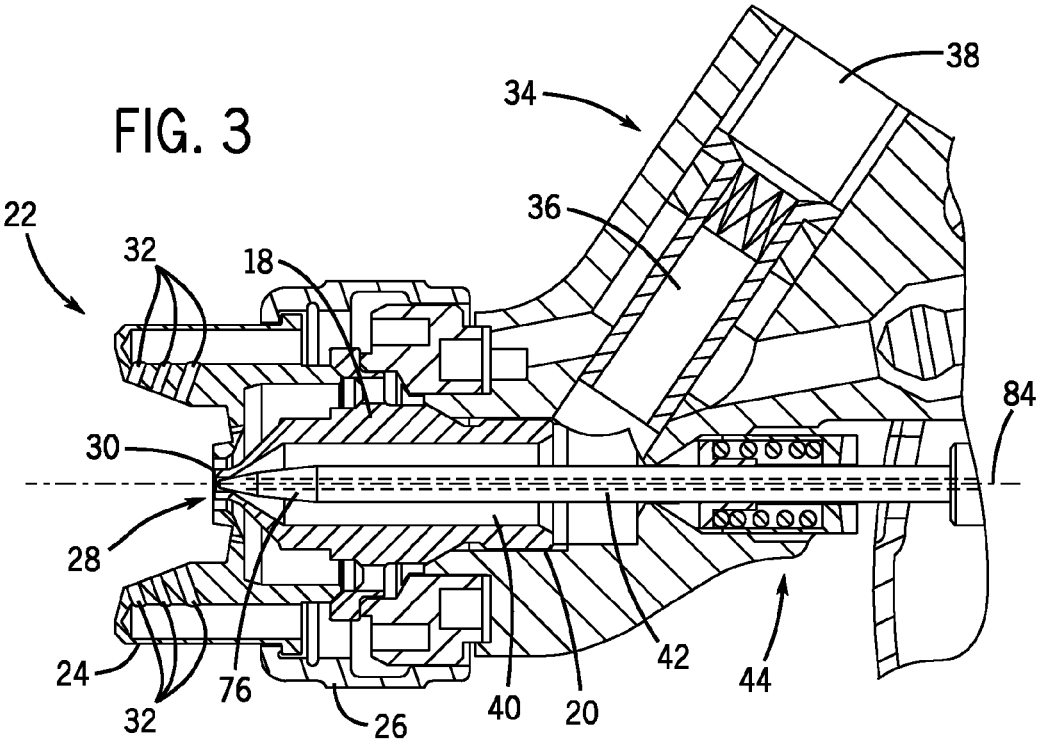
FIG. 3 is a partial cross-sectional side view of the spray device of FIGS. 1 and 2 when the trigger is not pulled.
Figure 4:
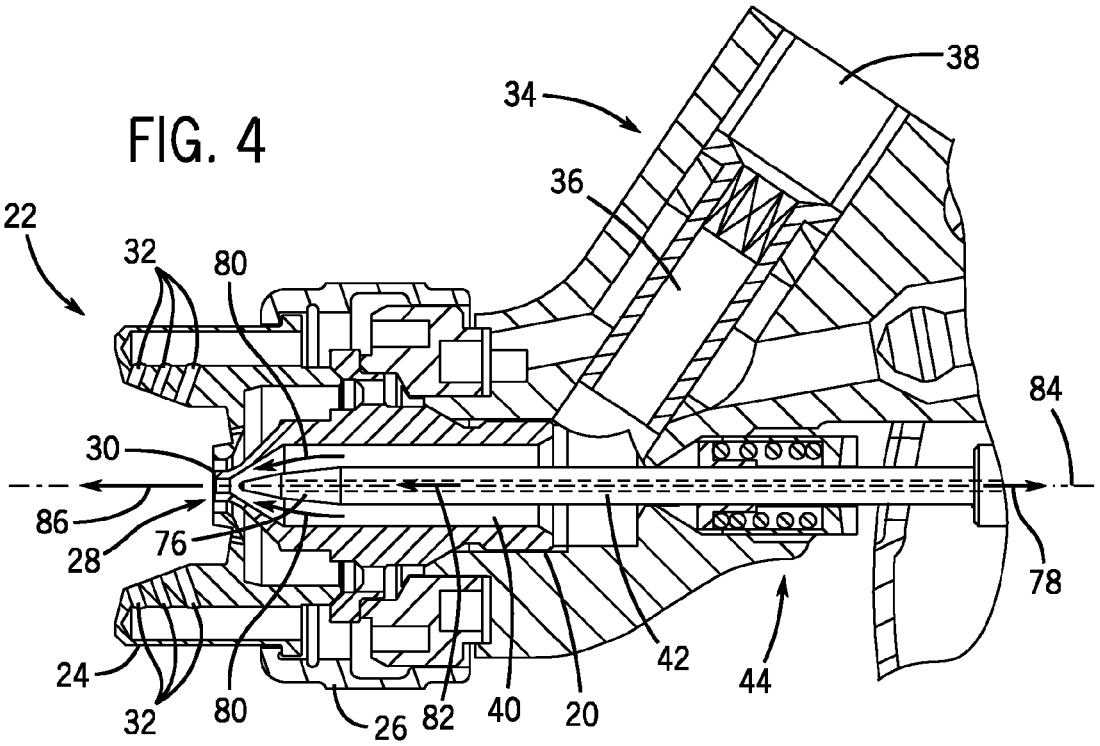
FIG. 4 is a partial cross-sectional side view of the spray device of FIGS. 1 and 2 when the trigger is pulled.

FIG. 3 is a partial cross-sectional side view of the spray device 12 of FIGS. 1 and 2 when the trigger 52 is not pulled. Conversely, FIG. 4 is a partial cross-sectional side view of the spray device 12 of FIGS. 1 and 2 when the trigger 52 is pulled. As such, FIGS. 3 and 4 illustrate how the flow of the first and second component materials are affected by the trigger 52. As illustrated in FIG. 3, when the trigger 52 is not being pulled, a tip 76 of the multiple component delivery needle 42 abuts the fluid tip exit 30 of the fluid delivery tip assembly 18. As such, the flow of the first component material may be at least partially blocked because there is little to no space between the tip 76 of the multiple component delivery needle 42 and the fluid tip exit 30 of the fluid delivery tip assembly 18. In addition, when the trigger 52 is not being pulled, the fluid valve 48 is not unseated (e.g., by the valve end 72 of the multiple component delivery needle 42), as described above with respect to FIGS. 1 and 2. Because the fluid valve 48 is not unseated, the flow of the second component material from the pressure vessel 74 is at least partially blocked. Therefore, the flow of the second component material through the hollow center of the multiple component delivery needle 42 is generally not pressurized. As such, the flow rate of the second component material from the hollow center of the multiple component delivery needle 42 may be negligible.

However, when the trigger 52 is being pulled, the multiple component delivery needle 42 moves away from the fluid tip exit 30 of the fluid delivery tip assembly 18, as illustrated by arrow 78 in FIG. 4. As such, the first component material may be allowed to flow around the tip 76 of the multiple component delivery needle 42 through the fluid tip exit 30 of the fluid delivery tip assembly 18, as illustrated by arrows 80. In addition, when the trigger 52 is being pulled, the fluid valve 48 is unseated (e.g., by the valve end 72 of the multiple component delivery needle 42), as described above with respect to FIGS. 1 and 2. Because the fluid valve 48 is unseated, the second component material is allowed to flow from the pressure vessel 74. In addition, the flow of the second component material through the hollow center of the multiple component delivery needle 42 is pressurized. As such, the second component material will flow through the hollow center of the multiple component delivery needle 42 to the fluid tip exit 30 of the fluid delivery tip assembly 18, as illustrated by arrow 82.

Because the second component material is pressurized due to the pressure in the pressure vessel 74, the second component material may generally flow from the hollow center of the multiple component delivery needle 42 through the fluid tip exit 30 of the fluid delivery tip assembly 18 along a common axis 84 of the multiple component delivery needle 42, the fluid delivery tip assembly 18, and the air atomization cap 24, as illustrated by arrow 86. However, the manner in which the first component material flows from the first component material chamber 40 through the fluid tip exit 30 of the fluid delivery tip assembly 18 may depend on whether the first component material is gravity fed, pressure fed, or suction fed into the first component material chamber 40.

Figure 5:
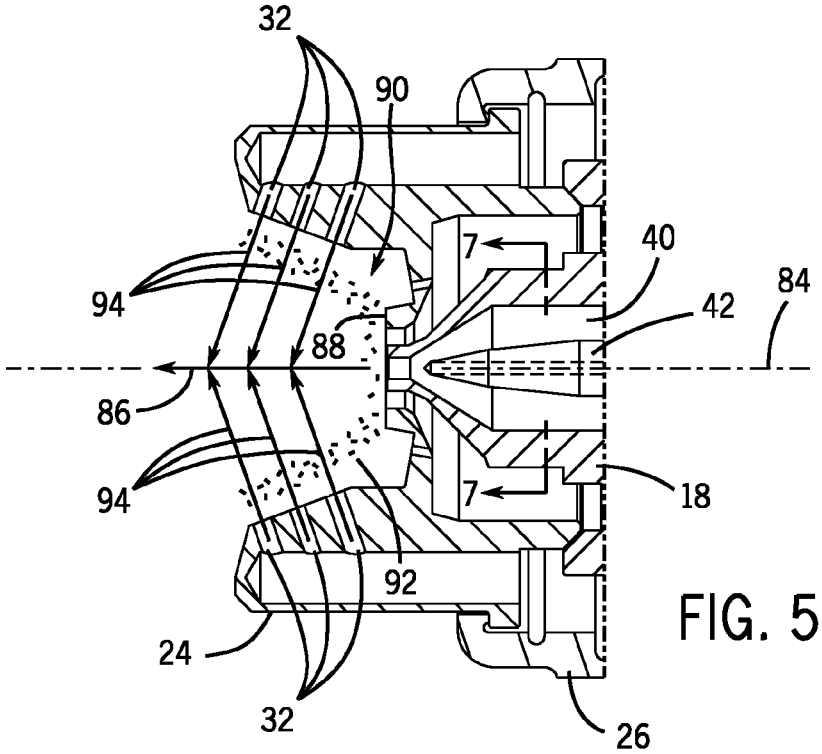
FIG. 5 is a partial cross-sectional side view of the spray device of FIGS. 1 through 4, wherein the trigger is pulled and the first component material is gravity fed or suction fed.

For example, FIG. 5 is a partial cross-sectional side view of the spray device 12 of FIGS. 1 through 4, wherein the trigger is pulled 52 and the first component material is gravity fed or suction fed. When the first component material is gravity fed, the pressure of the first component material within the first component material chamber 40 may be less than when the first component material is pressure fed. As such, instead of being forced through the fluid tip exit 30 of the fluid delivery tip assembly 18 by an applied pressure, the first component material may flow through the fluid tip exit 30 of the fluid delivery tip assembly 18 influenced by the forces of gravity. In addition, in certain embodiments, the first component material may be suction fed. For example, the first component material may be at least partially siphoned through the fluid tip exit 30 of the fluid delivery tip assembly 18 by a low pressure area along an exterior face 88 of the air atomization cap 24. The low pressure area is generally created by the pressurized flow of the second component material from the hollow center of the multiple component delivery needle 42. The suctioning effect may cause particles of the first component material to flow along an interior area 90 of the air atomization cap 24, as illustrated by 92, until the particles of the first component material reach the shaping air 94, which flows from the spray shaping orifices 32 of the air atomization cap 24. The shaping air 94 then directs the particles of the first component material toward the pressurized stream 86 of the second component material, where the first and second component materials may be mixed before being directed to the object being sprayed. The suctioning effect may actually exist for both a gravity fed or suction fed first component material. In fact, in certain embodiments, the suctioning effect may even impact the first component material when it is pressure fed.

Figure 6:
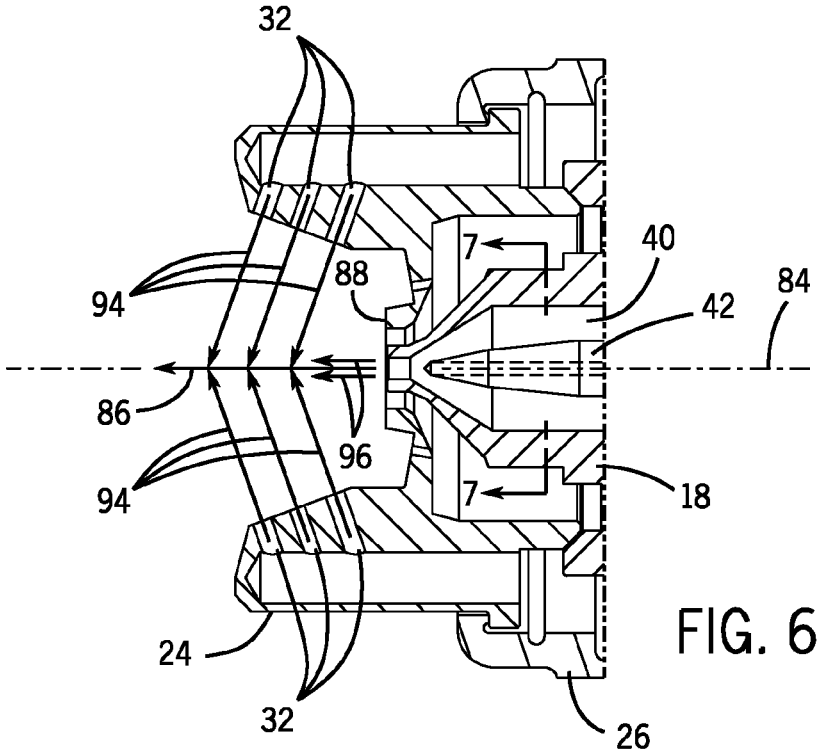
FIG. 6 is a partial cross-sectional side view of the spray device of FIGS. 1 through 4, wherein the trigger is pulled and the first component material is pressure fed.

Conversely, FIG. 6 is a partial cross-sectional side view of the spray device 12 of FIGS. 1 through 4, wherein the trigger is pulled 52 and the first component material is pressure fed. When the first component material is pressure fed, the pressure of the first component material within the first component material chamber 40 may be greater than when the first component material is gravity fed or suction fed. As such, the first component material may be forced through the fluid tip exit 30 of the fluid delivery tip assembly 18 by the applied pressure, as illustrated by arrows 96. Therefore, the pressurized streams 86, 96 of the first and second component materials may generally mix before, during, and after the shaping air 94 from the spray shaping orifices 32 of the air atomization cap 24.

In certain embodiments, when the multiple component delivery needle 42 is in a closed position, the tip 76 of the multiple component delivery needle 42 may extend past the front of the fluid tip exit 30. When the trigger 52 is pulled, the tip 76 of the multiple component delivery needle 42 may be approximately flush with the fluid tip exit 30. However, in other embodiments, when the multiple component delivery needle 42 is in a closed position, the tip 76 of the multiple component delivery needle 42 may be approximately flush with the fluid tip exit 30. When the trigger 52 is pulled, the tip 76 of the multiple component delivery needle 42 may be recessed inwardly within the fluid tip exit 30.

In any case (e.g., gravity feeding, suction feeding, or pressure feeding of the first component material), the first and second component materials are not premixed inside the spray device 12. Rather, the first and second component materials are delivered to the front of the spray device 12, where the first and second component materials are mixed external to the spray device 12 during atomization. However, in other embodiments, depending on the operating parameters (e.g., flow rate and/or pressure) of the first and second component materials, a certain amount of the mixing may actually occur near to or inside of the fluid tip exit 30 of the fluid delivery tip assembly 18. For example, the first and second component materials may be mixed where the first component material chamber 40 meets the fluid tip exit 30 of the fluid delivery tip assembly 18.

Figure 7:
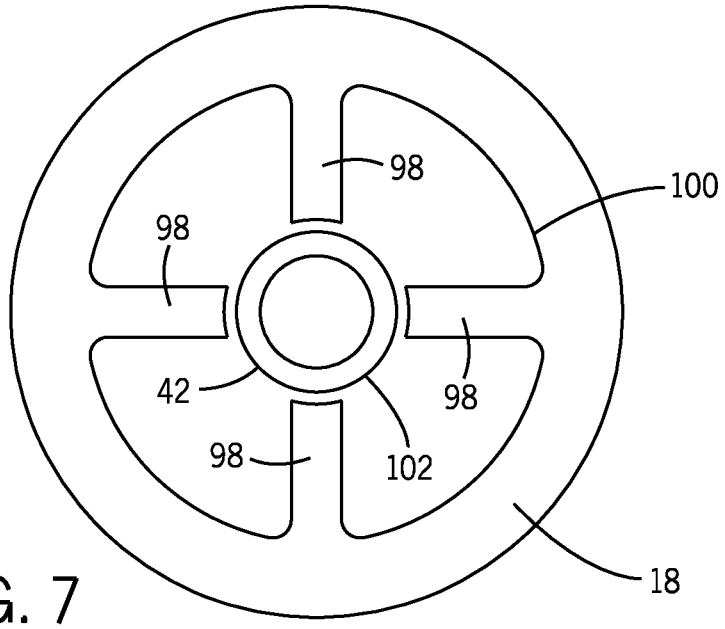
FIG. 7 is a cross-sectional axial view of the multiple component delivery needle and the fluid delivery tip assembly of the spray device of FIGS. 1 through 6.

In certain embodiments, the multiple component delivery needle 42 may have guides to help maintain concentricity within the interior of the fluid delivery tip assembly 18. For example, FIG. 7 is a cross-sectional axial view of the multiple component delivery needle 42 and the fluid delivery tip assembly 18 of the spray device 12 of FIGS. 1 through 6. As illustrated, the fluid delivery tip assembly 18 may include four guides 98 extending from an interior surface 100 of the fluid delivery tip assembly 18 to an exterior surface 102 of the multiple component delivery needle 42. The guides 98 ensure that the multiple component delivery needle 42 moves concentrically within the fluid delivery tip assembly 18 while also enabling the first component material to flow through the first component material chamber 40 within the fluid delivery tip assembly 18. The guides 98 illustrated in FIG. 7 are merely exemplary and not intended to be limiting. For example, in other embodiments, the multiple component delivery needle 42 may include guides that extend from the exterior surface 102 of the multiple component delivery needle 42 to the interior surface 100 of the fluid delivery tip assembly 18. In addition, any suitable number of guides may be used.

As described above, the multiple component delivery needle 42 includes a hollow center through which the second component material flows from the pressure vessel 74. In addition, as described above, the first component material flows from the first component material chamber 40 within the fluid delivery tip assembly 18 through the space between the fluid tip exit 30 of the fluid delivery tip assembly 18 and the exterior surface 102 of the multiple component delivery needle 42 when the trigger 52 is pulled. To aid the flow of the first component material through the fluid tip exit 30, in certain embodiments, the multiple component delivery needle 42 may include a plurality of openings 104 along the exterior circumferential surface 102 of the multiple component delivery needle 42.

Figure 8:
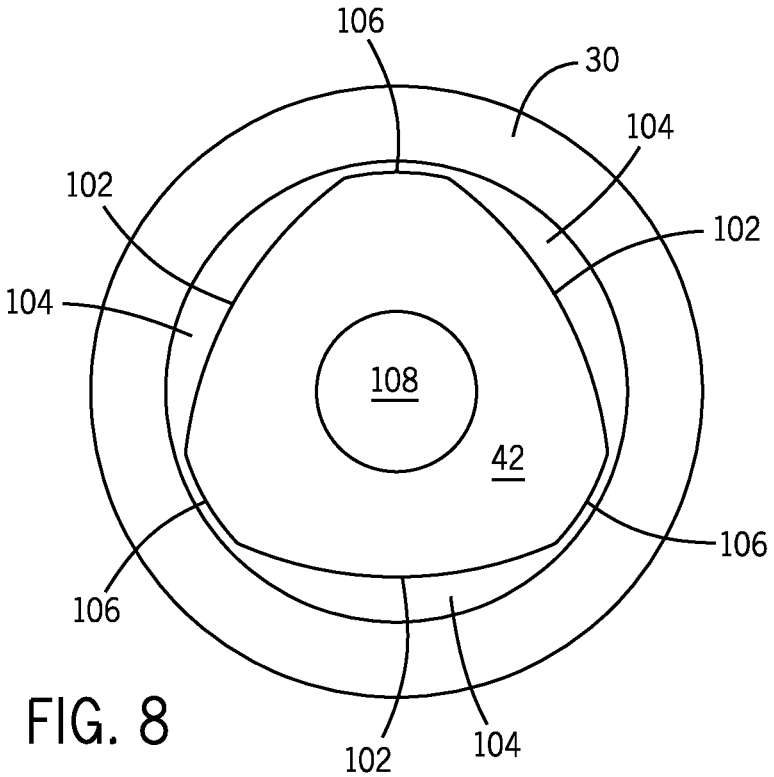
FIG. 8 is an axial view of an exemplary embodiment of the multiple component delivery needle and the fluid tip exit of the fluid delivery tip assembly.

For example, FIG. 8 is an axial view of an exemplary embodiment of the multiple component delivery needle 42 and the fluid tip exit 30 of the fluid delivery tip assembly 18. As illustrated, the multiple component delivery needle 42 includes three openings 104 along the exterior circumferential surface 102 near the tip 76 of the multiple component delivery needle 42. In other words, the exterior circumferential surface 102 of the multiple component delivery needle 42 does not completely abut the fluid tip exit 30 of the fluid delivery tip assembly 18 and enables flow of the first component material.

The openings 104 may generally be defined as indentions that extend axially along the exterior surface 102 near the tip 76 of the multiple component delivery needle 42. Any number of openings 104 may be used on the exterior circumferential surface 102 of the multiple component delivery needle 42. For example, in certain embodiments, the multiple component delivery needle 42 may include 2, 3, 4, 5, 6, or more openings 104. In addition, in the embodiment illustrated in FIG. 8, the openings 104 are formed by convex segments of the exterior circumferential surface 102 of the multiple component delivery needle 42. However, in other embodiments, the openings 104 may be formed by concave or straight-edged segments of the exterior circumferential surface 102 of the multiple component delivery needle 42. In certain embodiments, the multiple component delivery needle 42 may include edges 106 between the openings 104. The edges 106 may abut the fluid tip exit 30 of the fluid delivery tip assembly 18.

Figure 9:
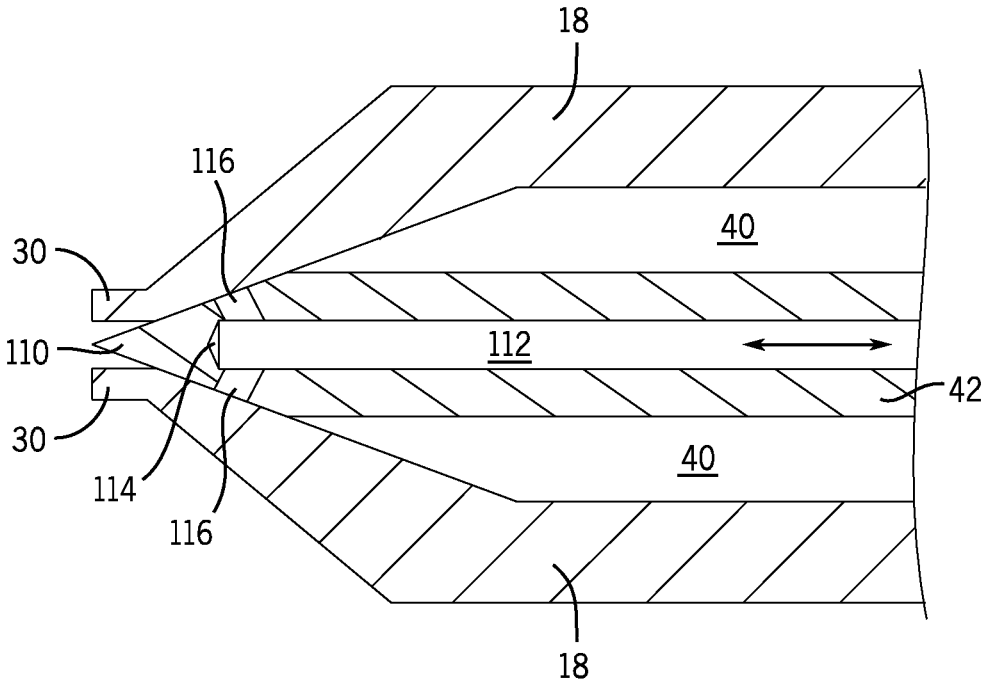
FIG. 9 is a partial cross-sectional side view of an exemplary embodiment of the multiple component delivery needle having a spray tip end that does not include an exit hole.

The multiple component delivery needle 42 of FIGS. 3 through 8 is illustrated as having a hollow center along the common axis 84 through an exit hole 108 at an end of the multiple component delivery needle 42. However, in other embodiments, the multiple component delivery needle 42 may be shaped differently at the end of the multiple component delivery needle 42 that abuts the fluid tip exit 30 of the fluid delivery tip assembly 18. For example, FIG. 9 is a partial cross-sectional side view of an exemplary embodiment of the multiple component delivery needle 42 having a spray tip end 110 that does not include the exit hole 108 at the common axis 84. Rather, the hollow center 112 of the multiple component delivery needle 42 illustrated in FIG. 9 terminates prior to the spray tip end 110 at a terminal wall 114.

Just upstream of the terminal wall 114, a plurality of exit holes 116 may be in fluid connection with the hollow center 112 of the multiple component delivery needle 42. The exit holes 116 may extend from the hollow center 112 at least partially radially and may seal against a tapper or other means within the fluid delivery tip assembly 18. In other words, when the trigger 52 is not being pulled and the multiple component delivery needle 42 abuts the fluid tip exit 30 of the fluid delivery tip assembly 18, the flow of the second component material through the hollow center 112 and the exit holes 116 of the multiple component delivery needle 42 may be impeded. However, when the trigger 52 is being pulled and the multiple component delivery needle 42 pulls away from the fluid tip exit 30 of the fluid delivery tip assembly 18, the flow of the second component material through the hollow center 112 and the exit holes 116 of the multiple component delivery needle 42 may be enabled. In this manner, the second component material may begin mixing with the first component material from the first component material chamber 40 just downstream of the exit holes 116. As such, the exit holes 116 against the fluid tip exit 30 of the fluid delivery tip assembly 18 may function as a valve, which may supplement and/or replace the functioning of the fluid valve 48 near the valve end 72 of the multiple component delivery needle 42 of FIGS. 1 and 2.

Figure 10:
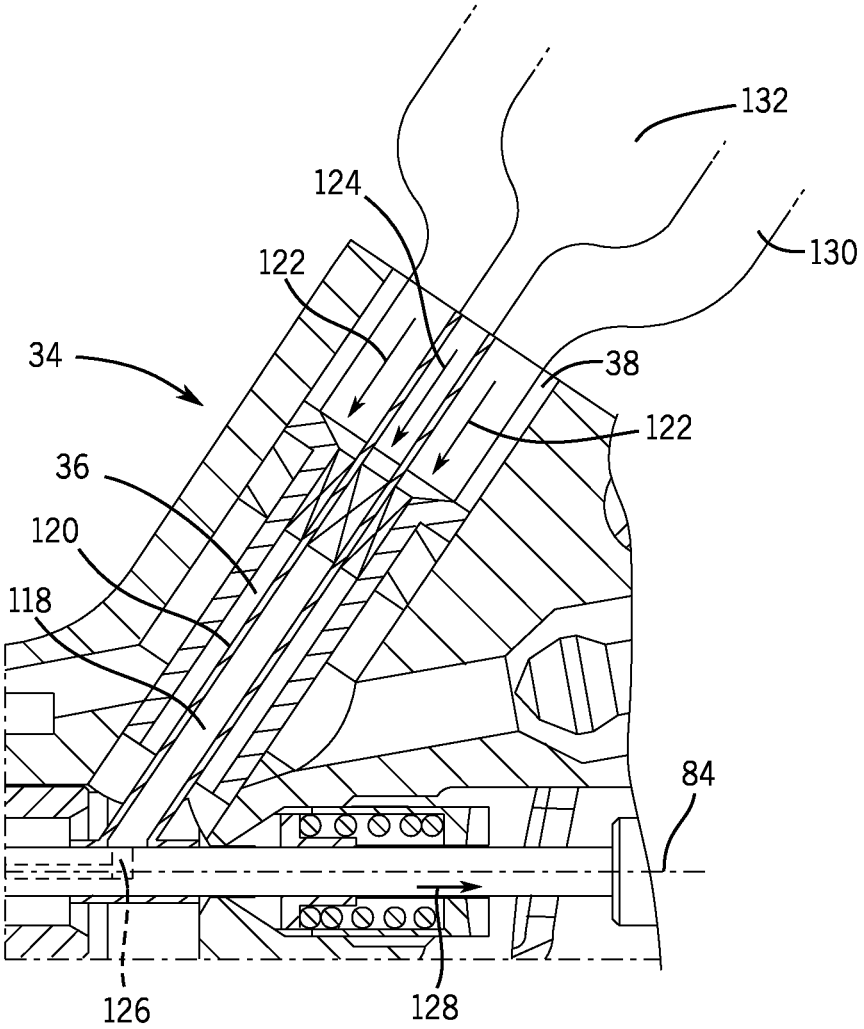
FIG. 10 is a partial cross-sectional side view of an exemplary embodiment of the spray device having a second component material inlet passage coaxially through a first component material inlet passage.

In addition, in certain embodiments, the first and second component materials may be fed from generally the same inlet location. For example, in certain embodiments, the second component material may not be fed from the valve end 72 of the multiple component delivery needle 42. Rather, the second component material may be fed coaxially through the first component material inlet passage 36. More specifically, the second component material may be fed through a second component material passage, which is coaxial within the first component material inlet passage 36. FIG. 10 is a partial cross-sectional side view of an exemplary embodiment of the spray device 12 having a second component material inlet passage 118 coaxially through the first component material inlet passage 36. As illustrated, a second component material tube 120 may be located within the first component material inlet passage 36 such that the second component material inlet passage 118 is coaxial within the first component material inlet passage 36.

The first component material may still be fed into the first component material chamber 40 through the first component material inlet passage 36, as illustrated by arrows 122. However, as illustrated by arrow 124, the second component material may be fed through the second component material tube 120, which defines the second component material inlet passage 118 within the first component material passage 36. Therefore, the hollow center 112 of the multiple component delivery needle 42 may only extend through the multiple component delivery needle 42 from the tip 76 of the multiple component delivery needle 42 to approximately where the second component material inlet passage 118 fluidly connects to the multiple component delivery needle 42.

The second component material may be fed into the hollow center 112 of the multiple component delivery needle 42 through cross holes 126 in the multiple component delivery needle 42. The cross holes 126 may extend from the hollow center 112 of the multiple component delivery needle 42 to the exterior circumferential surface 102 of the multiple component delivery needle 42. In certain embodiments, the cross holes 126 may not be in fluid connection with the second component material inlet passage 118 when the trigger 52 is not being pulled. However, the cross holes 126 may be brought into fluid connection with the second component material inlet passage 118 when the trigger 52 is pulled and the multiple component delivery needle 42 moves away from the fluid tip exit 30 of the fluid delivery tip assembly 18, as illustrated by arrow 128. In certain embodiments, the first and second component materials may be fed through a cup-within-a-cup design, wherein the first component material is fed through a first cup 130 that is located around a second cup 132, which is used to feed the second component material.

In certain embodiments, the first component material may comprise paint, whereas the second component material may comprise an activator (e.g., thinner). However, in other embodiments, different liquids may be used as the component materials with the disclosed embodiments. In other words, the multiple component delivery needle 42 and associated components of the spray device 12 may have applications with various types of plural component materials, and are not limited to paints and activators. In addition, although the disclosed embodiments disclose the use of two component materials, in other embodiments, more than two component materials may be used. For example, in certain embodiments, the hollow center passage within the multiple component delivery needle 42 may actually include two independent half-circle flow paths, or two parallel circular or non circular flow paths. As such, more than one component material may flow through the hollow center passage of the multiple component delivery needle 42. In this embodiment, the multiple component delivery needle 42 may be coupled to a single fluid valve or more than one fluid valve to deliver the multiple component materials through the multiple hollow passages within the multiple component delivery needle 42.

The embodiments described herein enable the delivery of the first component material between the fluid tip exit 30 of the fluid delivery tip assembly 18 and the exterior surface 102 of the multiple component delivery needle 42 while enabling the delivery of the second component material from the hollow center of the multiple component delivery needle 42. As described above, the delivery of the first and second component materials may be synchronized such that the first and second component materials mix in an appropriate ratio. By not premixing the first and second component materials, excess waste material created by the painter may be minimized because the painter only uses as much of the first and second component materials as needed. Further, because mixing of the first and second component materials generally occurs in front of the fluid tip exit 30 of the fluid delivery tip assembly 18, the disclosed embodiments may reduce cleanup time as well as provide the painter with more time before having to clean the components of the spray device 12. As such, the disclosed embodiments provide a user friendly, compact way of spraying multiple component materials.

Figure 11:
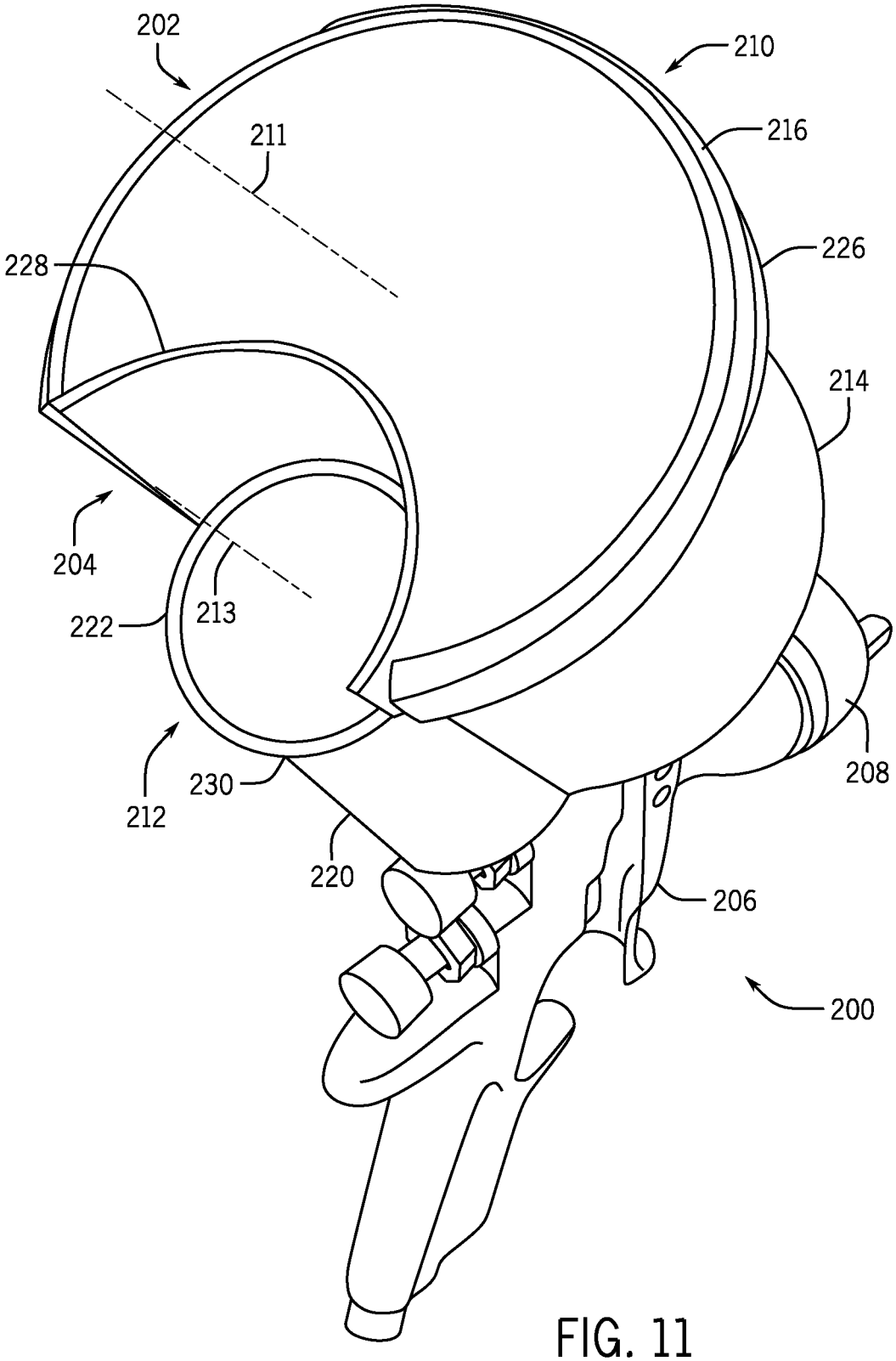
FIG. 11 is a perspective view of an exemplary embodiment of a spray device having a multi-component container having a nested configuration of containers, wherein each container has an outlet in a nonsymmetrical configuration (e.g., offset from) a central axis of the respective container.

FIG. 11 is a perspective view of an exemplary embodiment of a spray device 200 having a multi-component container 202 (e.g., gravity feed container) having a nonsymmetrical configuration 204. As discussed below, the term nonsymmetrical configuration may include a nonsymmetrical configuration of outlets, a nonsymmetrical shape of one or more container portions, a nested configuration of container portions, or a combination thereof. The nonsymmetry may be in reference to a central axis of each container portion, or a central axis of the entire multi-component container 202. As illustrated, the multi-component container 202 is coupled to a body 206 of the spray device 200, which also includes a spray head 208 that outputs a spray from multiple internal passages leading from the container 202 to the spray head 208. The multi-component container 202 is a one-piece or multi-piece container configured to store and supply multiple components (e.g., liquids) to the spray device 200, e.g., multiple paints, multiple colors, base and additive materials, and so forth. The illustrated multi-component container 202 comprises a first container portion 210 configured to supply a first liquid to a first liquid passage in the spray device 200, and a second container portion 212 configured to supply a second liquid to a second liquid passage in the spray device 200. However, the multi-component container 202 may have any number of container portions, e.g., 2 to 20 or more (e.g., 2, 3, 4, 5, 6, 7, 8, 9, 10, or more container portions).

In the embodiment of FIG. 11, the first and second container portions 210 and 212 are arranged in the nonsymmetrical configuration 204, which includes asymmetry of outlets of the container portions 210 and 212 relative to respective central axes 211 and 213 of the container portions 210 and 212, asymmetry of the shape of the container portion 210 relative to its central axis 211, and asymmetry of the assembly of the container portions 210 and 212 (e.g., nested configuration). For example, the nonsymmetrical configuration 204 of the outlets (discussed in further detail below with reference to FIGS. 12-19) has the outlets along edges or sidewalls of the respective container portions 210 and 212, such that the outlets are in close proximity to one another. By further example, the nonsymmetrical configuration 204 of the shape of the container portion 210 has a crescent shaped cross-section. By further example, the nonsymmetrical configuration 204 of the assembly of container portions 210 and 212 may be described as a docked configuration or a partially nested configuration, wherein the second container portion 212 partially extends into (and thus is partially surrounded by) the first container portion 210.

As further illustrated in FIG. 11, the first container portion 210 includes a first cup 214, a first cover or lid 216 disposed over an upper opening in the first cup 214, and a first outlet 218 (see FIG. 12) configured to supply a first liquid to a first liquid passage in the body 206 of the spray device 200. Similarly, the second container portion 210 includes a second cup 220, a second cover or lid 222 disposed over an upper opening in the second cup 220, and a second outlet 224 (see FIG. 12) configured to supply a second liquid to a second liquid passage in the body 206 of the spray device 200. In the illustrated embodiment, the first cup 214 has a generally cylindrical enclosure (or side wall) 226, which is interrupted by a semi-circular recess or groove 228 extending lengthwise along the enclosure 226. As a result, the first cup 214 has a generally crescent shaped cross-section, which extends along the axis 211. The second cup 220 has a generally cylindrical enclosure (or side wall) 230 disposed in the recess or groove 228. Although the cups 214 and 220 have generally cylindrical shapes, other embodiments of the cups 214 and 220 may have non-circular cross-sections, such as an oval, square, rectangular, triangular, polygonal, or generally curved section. Accordingly, the disclosed embodiments are not limited to any particular shape of the cups 214 and 220. Furthermore, in the illustrated embodiment, the first and second container portions 210 and 212 are sized differently from one another. In other embodiments, the a volumetric ratio of the first container portion 210 to the second container portion 212 may range between approximately 1:20 to 20:1, 1:10 to 10:1, 1:5 to 5:1, 1:2 to 2:1, or simply 1:1.

Furthermore, the nonsymmetrical configuration 204 of the multi-component container 202 may help provide a more uniform flow of each liquid to the spray device 200. For example, by providing the outlets 218 and 224 in close proximity to one another, each liquid flow path may be substantially the same, thereby providing a more uniform flow distance and thus flow rate of the liquids into the spray device. Otherwise, if each container portion 210 and 212 had an outlet at a different distance from the spray device 200, then the spray device 200 may receive non-uniform flow rates and/or amounts of each liquid, thereby causing non-uniformities in the liquid mixture and thus the liquid spray output by the spray device 200. Accordingly, the nonsymmetrical configuration 204 of the multi-component container 202 is configured to enable an efficient and high performance mixing of multiple components (e.g., liquid paints) directly in or at the spray device 200, thereby reducing waste in time and materials.

FIGS. 12-19 are schematics of exemplary embodiments of the multi-component container 202 of FIG. 11, illustrating various nonsymmetrical configurations of the outlets of the container portions, the shapes of the container portions, and/or the assembly of the container portions. Furthermore, FIGS. 12-19 each illustrate one or more fasteners 232 (e.g., first and second fasteners 234 and 236) coupling together the first and second container portions 210 and 212. These fasteners 232 (e.g., first and second fasteners 234 and 236) may include one or more removable fasteners (e.g., bolts, clamps, ties, screws, etc.), one or more fixed or integral fasteners (e.g., snap-fit mechanisms, dovetail joints, etc.), or any combination thereof. For example, each container portion 210 and 212 may include a mating portion of a joint, such as a dovetail joint, a snap-fit joint, or the like. Furthermore, fasteners 232 (e.g., first and second fasteners 234 and 236) may be integrated directly into the body of each container portion 210 and 212, thereby creating a first one-piece structure having the container portion 210 and a first integral fastener 234 (e.g., first dovetail joint portion or snap-fit portion 234), and a second one-piece structure having the container portion 212 and a second integral fastener 236 (e.g., second dovetail joint portion or snap-fit portion 236). However, any suitable fasteners 232 (e.g., first and second fasteners 234 and 236) may be used to connect the first and second container portions 210 and 212.

Figure 12:
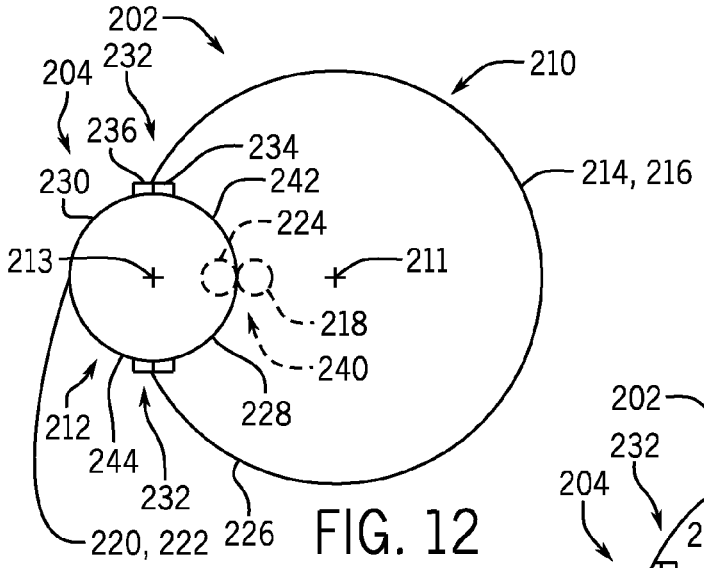
FIGS. 12-19 are schematics of exemplary embodiments of the multi-component container of FIG. 11.

FIG. 12 is a schematic of the multi-component container 202 of FIG. 11, illustrating the first and second outlets 218 and 224 in a nonsymmetrical configuration 240 (e.g., a side-by-side configuration 240 in close proximity to one another). As illustrated, each outlet 218 and 224 is offset from the central axis 211 or 213 of its respective container portion 210 or 212. For example, in certain embodiments, the outlets 218 and 224 may be directly adjacent one another or within a small offset distance from one another, such as an offset distance of less than approximately 1, 2, 3, 4, or 5 millimeters. As illustrated in FIG. 12, the nonsymmetrical configuration 204 includes a docked configuration or a partially nested configuration, because the second container portion 212 extends partially into the first container portion 210 (e.g., along groove 228). Furthermore, the cups 214 and 220 both have generally cylindrical enclosures 226 and 230, respectively. As a result, a first portion 242 of the second container portion 212 (e.g., cup 220) is nested within the outer boundary of the first container portion 210 (e.g., cup 214), while a second portion 244 of the second container portion 212 (e.g., cup 220) protrudes or extends outside of the outer boundary of the first container portion 210 (e.g., cup 214). However, other embodiments of the multi-component container 202 may have different nonsymmetrical configurations 204, e.g., different shaped cups 214 and 220 and/or different configurations of outlets 218 and 224.

Figure 13:
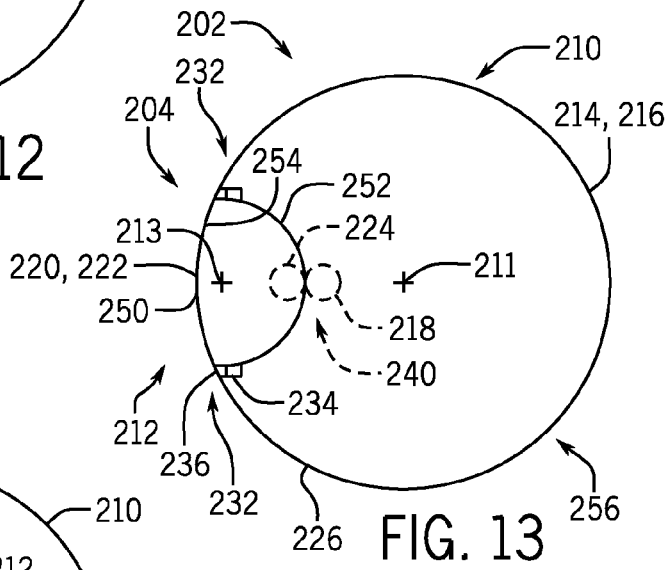

FIG. 13 is a schematic of the multi-component container 202 of FIG. 11, illustrating a different shape of the second container portion 212. In particular, the illustrated container portion 212 has a truncated cylindrical enclosure 250, rather than the generally cylindrical enclosure 230 of FIGS. 11 and 12. For example, the truncated cylindrical enclosure 242 has a generally cylindrical enclosure 252 that is truncated at a curved wall 254, which may have the same curvature or a different curvature as the generally cylindrical enclosure 226. In this manner, an outer boundary 256 of the multi-component container 202 may be a full circle, or another generally continuous shape, because the curved wall 254 may be generally flush with the generally cylindrical enclosure 226. However, in the illustrated embodiment, the shapes of both container portions 210 and 212 (e.g., outer boundary) are nonsymmetrical about the respective central axes 211 and 213. In addition, the outlets 218 and 224 are in nonsymmetrical positions (e.g., off center) relative to the respective central axes 211 and 213.

Figure 14:
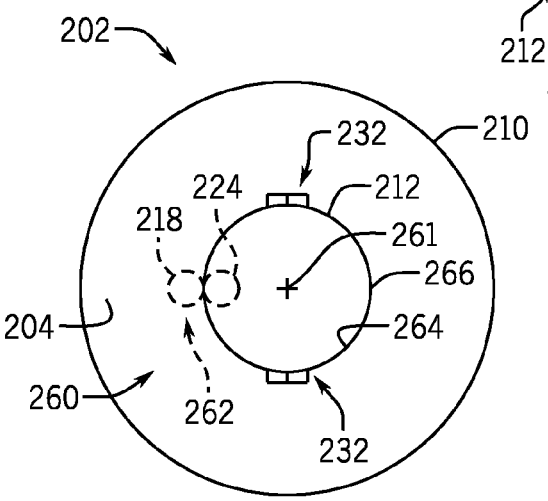

FIG. 14 is a schematic of the multi-component container 202 of FIG. 11, illustrating an embodiment of the nonsymmetrical configuration 204, wherein the first container portion 210 extends around the second container portion 212 in a nested configuration 260, while the outlets 218 and 214 are both in nonsymmetrical configuration relative to a central axis 261 of the container portions 210 and 212 as well as the entire multi-component container 202. The nested configuration 260 may be a coaxial or concentric arrangement of the first and second container portions 210 and 212, or the nested configuration 260 may be an offset configuration (nonsymmetrical configuration) of the first and second container portions 210 and 212. In either case, the first and second outlets 218 and 224 have a nonsymmetrical configuration 262 relative to the respective container portions 210 and 212. In particular, the first outlet 218 is disposed along an inner perimeter 264 of the first container portion 210, while the second outlet 224 is disposed along an outer perimeter 266 of the second container portion 212. In this manner, the first and second outlets 218 and 224 are disposed in close proximity to one another in the nonsymmetrical configuration 262, e.g., in a side-by-side configuration. This close proximity of the outlets 218 and 224 (e.g., side-by-side configuration 262) helps to provide uniform flow rates (and thus amounts) of both the first and second liquids to the spray device 200.

Figure 15:
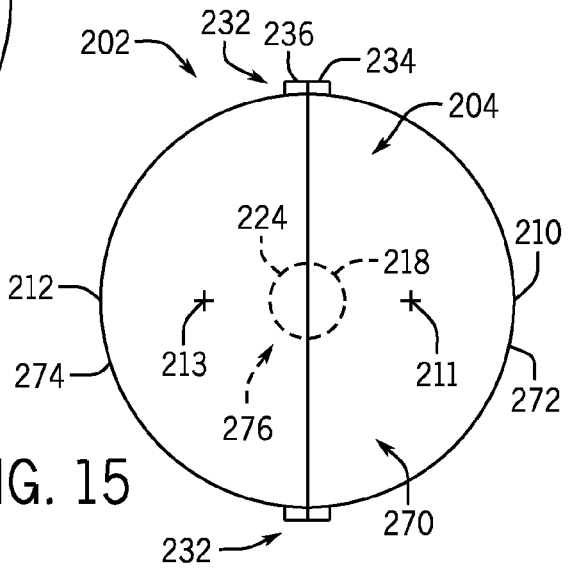

FIG. 15 is a schematic of the multi-component container 202 of FIG. 11, illustrating an embodiment of the nonsymmetrical configuration 204, wherein the first container portion 210 and the second container portion 212 are arranged in a side-by-side configuration 270. In particular, the illustrated container portions 210 and 212 each have a semicircular cross-section, such that the first container portion 210 has a first truncated cylindrical enclosure 272 and the second container portion 212 has a second truncated cylindrical enclosure 274. As a result, the first container portion 210 has a nonsymmetrical shape relative to its central axis 211, and the second container portion 212 has a nonsymmetrical shape relative to its central axis 213. Furthermore, the first outlet 218 has a first truncated cylindrical shape, while the second outlet 224 has a second truncated cylindrical shape. As a result, the first outlet 218 has a nonsymmetrical shape relative to its axis, and the second outlet 224 has a nonsymmetrical shape relative to its axis. The first and second outlets 218 and 224 are also in a nonsymmetrical configuration 276 (e.g., a side-by-side configuration) relative to the respective central axes 211 and 213 of the container portions 210 and 212. In this manner, the first and second container portions 210 and 212 are mounted directly adjacent one another, while also maintaining the first and second outlets 218 and 224 in close proximity to one another, e.g., in the side-by-side configuration 276. This close proximity of the outlets 218 and 224 (e.g., side-by-side configuration 276) helps to provide uniform flow rates (and thus amounts) of the multiple liquids to the spray device 200.

Figure 16:
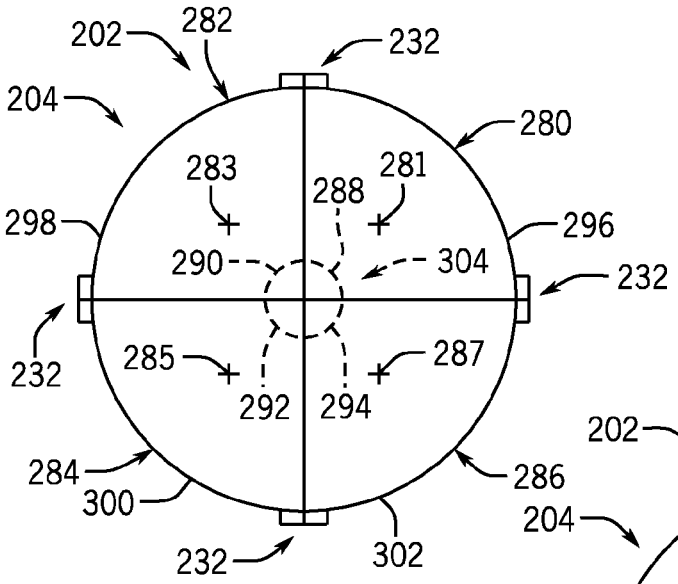

FIG. 16 is a schematic of the multi-component container 202 of FIG. 11, illustrating an embodiment of the nonsymmetrical configuration 204, wherein the container 202 includes first, second, third, and fourth container portions 280, 282, 284, and 286 and associated outlets 288, 290, 292, and 294. Again, the nonsymmetrical configuration 204 of the container portions 280, 282, 284, and 286 may be described as a side-by-side configuration or a pie-shaped configuration, wherein each container portion 280, 282, 284, and 286 has a nonsymmetrical shape relative to its respective central axis 281, 283, 285, and 287. In particular, the illustrated container portions 280, 282, 284, and 286 each have a quarter circular cross-section, such that the first container portion 280 has a first quarter cylindrical enclosure 296, the second container portion 282 has a second quarter cylindrical enclosure 298, the third container portion 284 has a third quarter cylindrical enclosure 300, and the fourth container portion 286 has a fourth quarter cylindrical enclosure 302. The outlets 288, 290, 292, and 294 also have nonsymmetrical shapes relative to their respective axes, and each outlet 288, 290, 292, and 294 is disposed in a nonsymmetrical position (e.g., off center) relative to the respective axis 282, 283, 285, or 287 of its container portion 280, 282, 284, or 286. For example, the first outlet 288 has a first quarter cylindrical shape, the second outlet 290 has a second quarter cylindrical shape, the third outlet 292 has a third quarter cylindrical shape, and the fourth outlet 294 has a fourth quarter cylindrical shape. In this manner, the container portions 280, 282, 284, and 286 are mounted directly adjacent one another, while also maintaining the outlets 288, 290, 292, and 294 in close proximity to one another, e.g., in a nonsymmetrical configuration 304 (e.g., a side-by-side configuration 304). This close proximity of the outlets 288, 290, 292, and 294 (e.g., side-by-side configuration 304) helps to provide uniform flow rates (and thus amounts) of the multiple liquids to the spray device 200.

Figure 17:
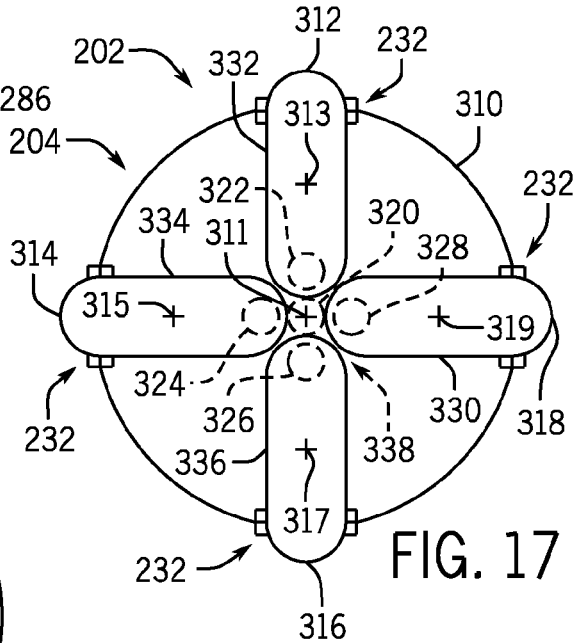

FIG. 17 is a schematic of the multi-component container 202 of FIG. 11, illustrating an embodiment of the nonsymmetrical configuration 204, wherein the container 202 includes first, second, third, fourth, and fifth container portions 310, 312, 314, 316, and 318 and associated outlets 320, 322, 324, 326, and 328. As illustrated, the nonsymmetrical configuration 204 of the container portions 310, 312, 314, 316, and 318 may be described as a docked configuration or a partially nested configuration, wherein at least the container portion 310 has a nonsymmetrical shape relative to its central axis 311. For example, the container portion 310 includes outer recesses or container receptacles 330, 332, 334, and 336 to accommodate the container portions 312, 314, 316, and 318, such that the container portion 310 has a nonsymmetrical shape. The illustrated container portions 312, 314, 316, and 318 each have an oval shaped cross-section (e.g., an elongated oval enclosure), which is partially nested or docked within corresponding recesses 330, 332, 334, and 336 in the container portion 310. Furthermore, the outlets 320, 322, 324, 326, and 328 are disposed in close proximity to one another in a nonsymmetrical configuration 338 (e.g., a side-by-side configuration 338). Again, the outlets 322, 324, 326, and 328 are in nonsymmetrical positions (e.g., off center) relative to respective central axes 313, 315, 317, and 319 of the container portions 322, 324, 326, and 328. For example, the outlets 322, 324, 326, and 328 (e.g., peripheral outlets) are positioned directly along or adjacent the inner edges of the container portions 322, 324, 326, and 328 around the outlet 320 (e.g., central outlet). This close proximity of the outlets 320, 322, 324, 326, and 328 (e.g., side-by-side configuration 338) helps to provide uniform flow rates (and thus amounts) of the multiple liquids to the spray device 200.

Figure 18:
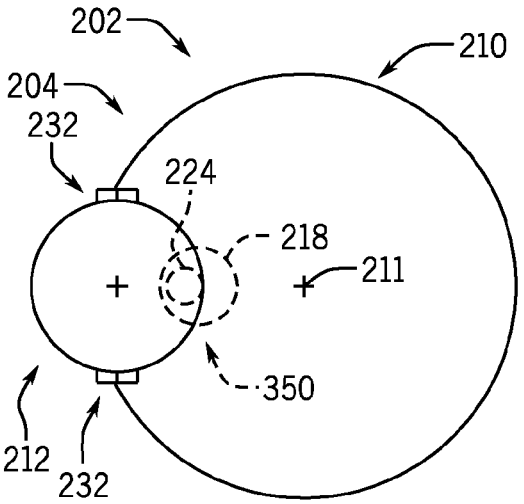

FIG. 18 is a schematic of the multi-component container 202 of FIG. 11, illustrating an embodiment of the nonsymmetrical configuration 204, wherein the container 202 includes the first and second container portions 210 and 212 in the docket configuration or partially nested configuration shown in FIGS. 11 and 12. In addition, the outlets 218 and 224 are disposed in a nonsymmetrical configuration 350 (e.g., a nested configuration 350), such that the first outlet 218 surrounds the second outlet 224. This close proximity of the outlets 218 and 224 (e.g., nested configuration 350) helps to provide uniform flow rates (and thus amounts) of both the first and second liquids to the spray device 200. Again, the outlets 218 and 224 are disposed in nonsymmetrical positions (e.g., off center) relative to central axes 211 and 213 of the container portions 210 and 212.

Figure 19:
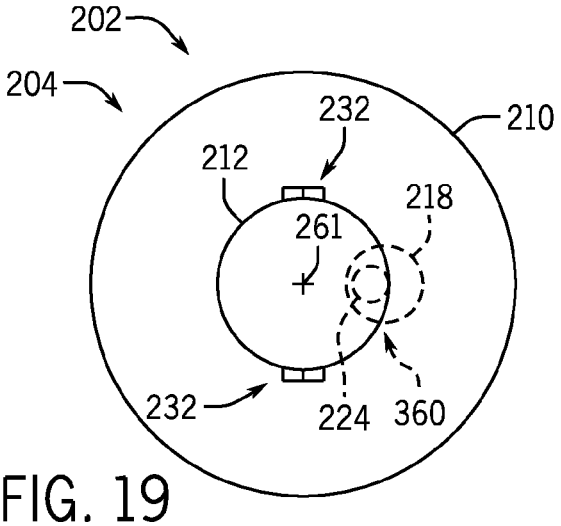

FIG. 19 is a schematic of the multi-component container 202 of FIG. 11, illustrating an embodiment of the nonsymmetrical configuration 204, wherein the container 202 includes the first and second container portions 210 and 212 in the nested configuration shown in FIGS. 11 and 14. In addition, the outlets 218 and 224 are disposed in a nonsymmetrical configuration 360 (e.g., a nested configuration 360), such that the first outlet 218 surrounds the second outlet 224. This close proximity of the outlets 218 and 224 (e.g., nested configuration 360) helps to provide uniform flow rates (and thus amounts) of both the first and second liquids to the spray device 200. Again, the outlets 218 and 224 are disposed in nonsymmetrical positions (e.g., off center) relative to the central axis 261 of the container portions 210 and 212 and the entire multi-component container 202.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a spray device, comprising:

a body having a first liquid passage configured to flow a first liquid and a second liquid passage configured to flow a second liquid;

a spray head configured to output a spray of the first liquid and the second liquid; and a multi-component container coupled to the body, wherein the multi-component container comprises a first container portion having a first outlet configured to supply the first liquid to the first liquid passage and a second container portion having a second outlet configured to supply the second liquid to the second liquid passage, the first and second outlets are positioned in close proximity to one another, the first container portion comprises a first fastener, the second container portion comprises a first mating fastener, the first and second container portions are removably coupled together via a first coupling of the first fastener with the first mating fastener, a second outer wall of the second container portion is at least partially disposed in a recess extending into a first outer wall of the first container portion, and the first outer wall does not completely surround the second outer wall, wherein the first outlet is offset from a first central axis of the first container portion, and the second outlet is offset from a second central axis of the second container portion.

2. The system of claim 1, wherein the first and second outlets are arranged in a nested configuration.

3. The system of claim 1, wherein the first and second outlets are arranged in a side-by-side configuration.

4. The system of claim 1, wherein the first outlet has a first nonsymmetrical shape relative to a first axis of the first outlet, and the second outlet has a second nonsymmetrical shape relative to a second axis of the second outlet.

5. The system of claim 1, wherein the first container portion and the second container portion are coupled to one another in a nested configuration.

6. The system of claim 1, wherein the first container portion and the second container portion are coupled to one another in a side-by-side configuration.

7. The system of claim 1, wherein the first outer wall extends about a first axis, the first outer wall extends laterally inward toward the first axis to define the recess, and the recess is open laterally away from the first axis.

8. The system of claim 7, wherein the first container portion comprises a first cylindrical enclosure having the first outer wall, the recess comprises a generally semi-circular groove extending into the first outer wall and extending lengthwise along the first cylindrical enclosure, and the second container portion comprises a second cylindrical enclosure disposed in the semi-circular groove.

9. The system of claim 1, wherein the first container portion comprises a second fastener, the second container portion comprises a second mating fastener, and the first and second container portions are removably coupled together via a second coupling of the second fastener with the second mating fastener.

10. The system of claim 9, wherein the first and second fasteners are fixed to the first container portion, and the first and second mating fasteners are fixed to the second container portion.

11. The system of claim 1, wherein an outer perimeter of the multi-component container has a nonsymmetrical configuration relative to a first axis of the first container portion.

12. The system of claim 1, wherein an outer perimeter of the multi-component container has a circular shape defined by the first and second container portions.

13. The system of claim 1, wherein the multi-component container comprises a third container portion having a third outlet, wherein the first, second, and third outlets are positioned in close proximity to one another.

14. The system of claim 1, wherein a first one-piece structure has the first container portion with the first fastener, and a second one-piece structure has the second container portion with the first mating fastener.

15. The system of claim 1, wherein the first fastener comprises a first snap-fit or dovetail joint, and the first mating fastener comprises a first mating snap-fit or dovetail joint.

16. A system, comprising:

a gravity feed spray container configured to supply multiple liquids to a spray device, wherein the gravity feed spray container comprises a first container portion having a first outlet configured to supply a first liquid and a second container portion having a second outlet configured to supply a second liquid, the first and second outlets are arranged in close proximity to one another, the first container portion comprises a first fastener, the second container portion comprises a first mating fastener, the first and second container portions are removably coupled together via a first coupling of the first fastener with the first mating fastener, a second outer wall of the second container portion is at least partially disposed in a recess extending into a first outer wall of the first container portion, and the first outer wall does not completely surround the second outer wall, wherein the first outlet is offset from a first central axis of the first container portion, and the second outlet is offset from a second central axis of the second container portion.

17. The system of claim 16, wherein the first and second outlets are arranged in a nested configuration or a side-by-side configuration in close proximity to one another.

18. The system of claim 16, wherein the first container portion and the second container portion are coupled to one another in a nested configuration.

19. The system of claim 16, wherein the first container portion and the second container portion are coupled to one another in a side-by-side configuration.

20. The system of claim 16, wherein the first outer wall extends about a first axis, the first outer wall extends laterally inward toward the first axis to define the recess, and the recess is open laterally away from the first axis.

21. The system of claim 16, wherein the first container portion comprises a second fastener, the second container portion comprises a second mating fastener, and the first and second container portions are removably coupled together via a second coupling of the second fastener with the second mating fastener.

22. The system of claim 16, wherein an outer perimeter of the gravity feed spray container has a nonsymmetrical configuration relative to a first axis of the first container portion.

23. The system of claim 16, wherein an outer perimeter of the gravity feed spray container has a circular shape defined by the first and second container portions.

24. The system of claim 16, wherein the gravity feed spray container comprises a third container portion having a third outlet, wherein the first, second, and third outlets are positioned in close proximity to one another.

25. The system of claim 16, wherein the first fastener is fixed to the first container portion, and the first mating fastener is fixed to the second container portion.

26. The system of claim 16, wherein the first fastener comprises a first snap-fit or dovetail joint, and the first mating fastener comprises a first mating snap-fit or dovetail joint.

* * * * *